US005178913A

United States Patent [19]

Kusunoki et al.

[11] Patent Number: 5,178,913

[45] Date of Patent: Jan. 12, 1993

[54] PAINTING MASK

[75] Inventors: Gen Kusunoki, Nagoya; Toshio Kai, Okazaki; Ikuo Watanabe, Toyota, all of Japan

[73] Assignee: Toyota Jidosha Kabushiki Kaisha, Toyota, Japan

[21] Appl. No.: 562,660

[22] Filed: Aug. 3, 1990

Related U.S. Application Data

[63] Continuation of Ser. No. 292,043, Dec. 30, 1988.

[30] Foreign Application Priority Data

Jan. 13, 1988 [JP] Japan ..... 63-2970[U]

[51] Int. Cl.[5] ..... B05C 11/00

[52] U.S. Cl. ..... 427/282; 118/504; 118/505; 156/195; 427/259; 427/272

[58] Field of Search ..... 118/504, 505; 156/195, 156/247; 427/259, 272, 282

[56] References Cited

U.S. PATENT DOCUMENTS 2,919,218 12/1959 May ..... 118/504 X
3,032,433 5/1962 Lewis et al. ..... 118/505 X
4,033,803 7/1977 Coder ..... 427/282 X

FOREIGN PATENT DOCUMENTS 57-19056 2/1982 Japan .
58-79569 5/1983 Japan .
62-5851 1/1987 Japan .
62-27768 2/1987 Japan .
62-862 5/1987 Japan .

*Primary Examiner*—David A. Simmons
*Assistant Examiner*—James J. Engel, Jr.
*Attorney, Agent, or Firm*—Finnegan, Henderson, Farabow, Garrett and Dunner

[57] ABSTRACT

A mask for covering part of the surface of the material to be coated comprises an aluminum foil, and a film of a resin provided on one surface of the foil and having a high power of adhering to the foil and any film of paint formed on the resin film. The film of paint which is formed on the resin film when the paint applied to the material to be coated is baked in an oven does not peel off and contaminate the interior of the oven. No such paint film peels off and adheres to the coated surface of the coated product, either, but the mask ensures the improved quality of the coated surface.

6 Claims, 2 Drawing Sheets

FIG. 1
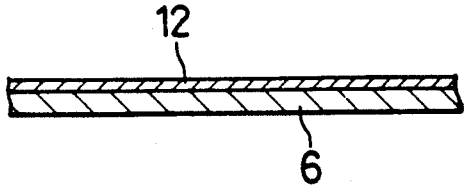
FIG. 2
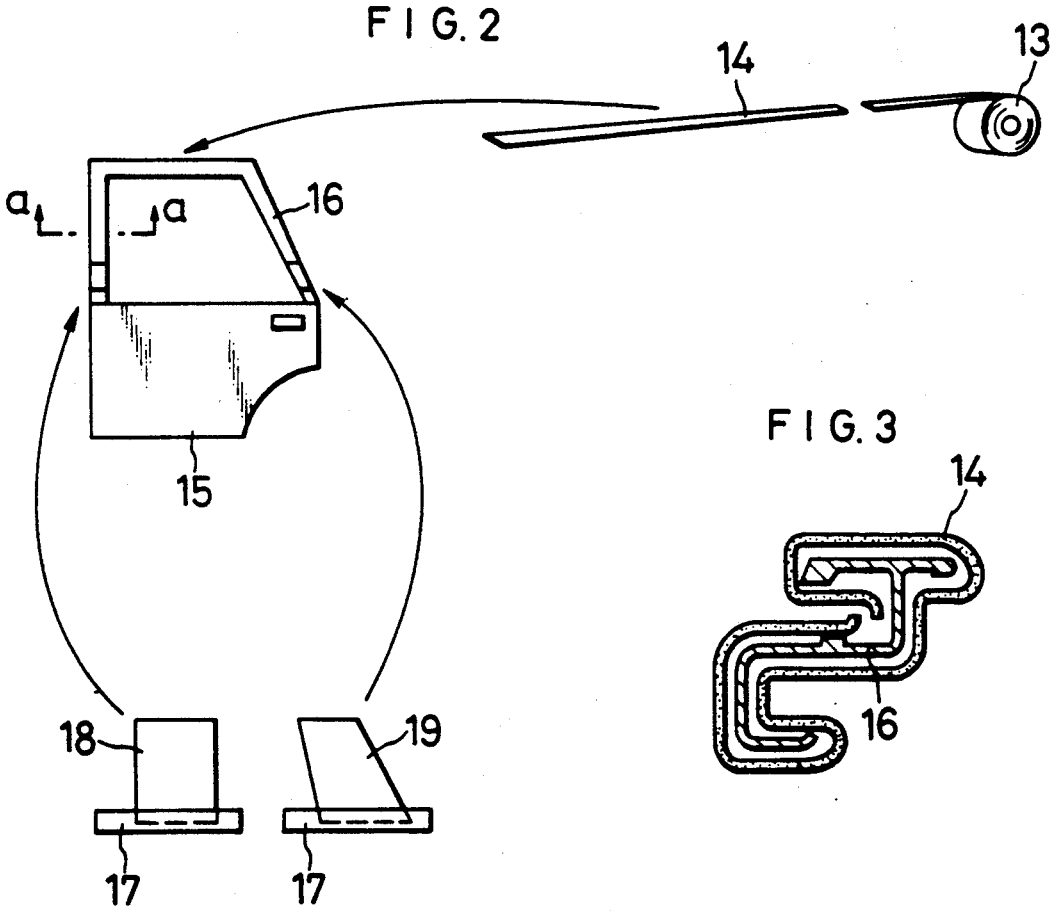
FIG. 3
FIG. 4
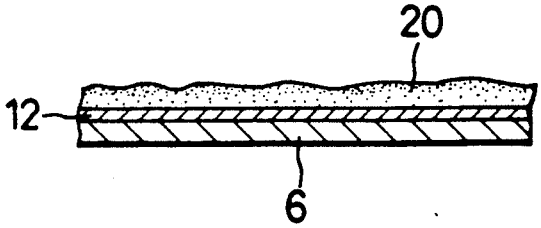

PAINTING MASK

This is a continuation of application Ser. No. 07/292,043, filed Dec. 30, 1988.

BACKGROUND OF THE INVENTION

1. Field of the Invention

This invention relates to a painting mask, or a material used for masking part of the surface to be coated.

2. Description of the Prior Art

There is known a mask which is used for covering a part of the surface to be finally coated, so that the covered surface may form a part of the surface of a final product. This kind of mask is used for obtaining, for example, a two-tone decorative finish on the body of an automobile, or a black finish on its door sash or locker.

An aluminum foil is often used for a mask which is used for making a black finish on, for example, a door sash. An aluminum foil is so flexible that it can easily adapt itself to the shape of the surface to be masked, and can also retain its own deformed shape. It eliminates or minimizes the necessity for a tape which is usually required for holding the mask in position. The use of an aluminum foil, therefore, contributes greatly to reducing the time and labor which are required for the masking and hence painting operation, and the cost thereof.

Japanese Utility Model Application Laid-Open No. 5851/1987 discloses a mask which comprises an aluminum foil 6 having a plurality of corrugations 1 in at least a portion thereof, as shown in FIG. 5. Japanese Utility Model Application Laid-Open No. 27768/1987 discloses a mask comprising an adhesive layer 3, removable paper 2 attached to the adhesive layer 3, a corrosion resistant metal or plastic sheet 4 attached to the adhesive layer 3 on the opposite side thereof from the removable paper 2, and a backing 5 attached to the sheet 4 along the edges thereof, as shown in FIG. 6.

Japanese Utility Model Application Laid-Open No. 62862/1987 discloses a mask which is used for covering a matted portion of the surface to be coated before finish coating is given to it. It comprises an aluminum foil 6 and a heat resistant sheet 7 attached to one surface of the foil 6 and formed from a material which is not adherent to the matted surface, as shown in FIG. 7.

Japanese Patent Application Laid-Open No. 19056/1982 discloses a mask formed from a soft plastic material, such as a soft polyvinyl chloride resin. Japanese Patent Application Laid-Open No. 79569/1983 discloses a mask comprising a laminated assembly of an adhesive layer 8, a foil 9 of a metal, such as aluminum, a removable layer 10 and a base layer 11 formed from, for example, a film of an appropriate material, as shown in FIG. 8.

While several known forms of masks have been described, some of them are of the multilayer construction and, therefore, require a complicated manufacturing process and are expensive. The mask consisting solely of a plastic film lacks the adaptability and shape retainability which an aluminum foil possesses. The mask consisting solely of an aluminum foil also has a drawback. The paint which has adhered to the foil easily peels off the foil when the baking step of the coating operation has been finished. It scatters and contaminates the interior of an oven. It is also likely to adhere to the coated surface of e.g. an automobile body and make it defective.

SUMMARY OF THE INVENTION

Under these circumstances, it is an object of this invention to provide a painting mask which is easy to manufacture, which can excellently adapt itself to the shape of the surface to be coated and retain its own deformed shape, and which can effectively resist the separation of any adhering paint therefrom when the paint on the coated surface is baked.

This object is attained by a mask comprising an aluminum foil, and a film of a resin provided on one surface of the foil and having a high power of adhering to both the foil and any paint applied onto the film.

The paint adhering to the mask of this invention does not peel off in the baking oven, but remains adherent thereto. Therefore, it does not contaminate the interior of the oven, or form any coating defect on the coated surface of a product. The paint adhering to the mask does not peel off, either, when the mask is removed from the product. Therefore, the use of the mask according to this invention prevents any electrostatic adhesion of paint to the coated surface of the product that has hitherto been a source of trouble. The use of the mask according to this invention enables a drastic reduction in the frequency of any cleaning work accompanying its removal, and thereby an improved efficiency of any such coating operation. It also ensures an improved working environment, as no paint or fragment of a coated film scatters away from the mask.

The mask of this invention is easy to manufacture and is inexpensive. It can excellently adapt itself to the shape of the surface to be masked, and retain its own shape as deformed when it is adapted to the surface to be masked. No special care is required for its use. It can be used as easily as any conventional aluminum foil. It can, therefore, be used for a wide range of masking application.

BRIEF DESCRIPTION OF THE DRAWINGS

FIG. 1 is a fragmentary cross-sectional view of a mask embodying this invention;

FIG. 2 is a schematic view showing the use of the mask by way of example;

FIG. 3 is a sectional view of the frame of a rear door assembly as taken along the line a—a of FIG. 2;

FIG. 4 is a fragmentary cross-sectional view of the mask removed from the masked surface after the paint applied for the final coating has been baked, and carrying a film of paint sprayed over it;

DETAILED DESCRIPTION OF THE INVENTION

Figure 5:
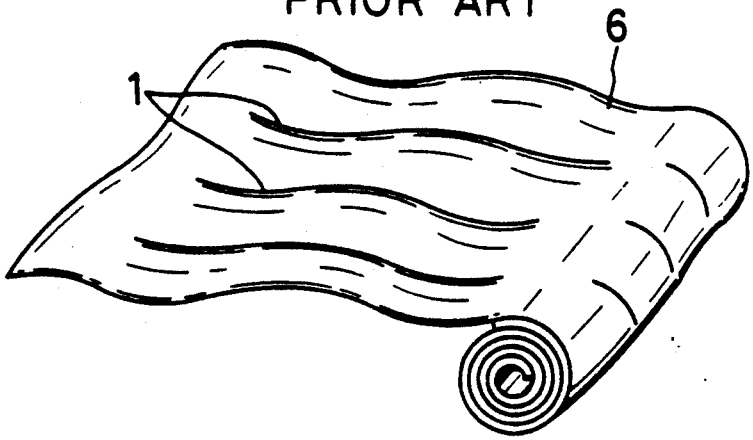
FIG. 5 PRIOR ART
FIG. 5 is a perspective view of a known mask.
Figure 6:
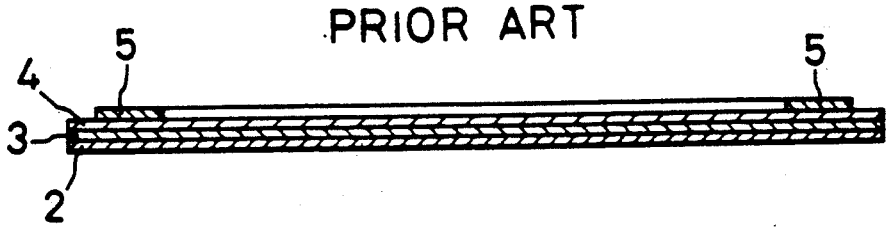
FIG. 6 PRIOR ART
FIGS. 6 to 8 are cross-sectional views of other known masks, respectively.
Figure 7:
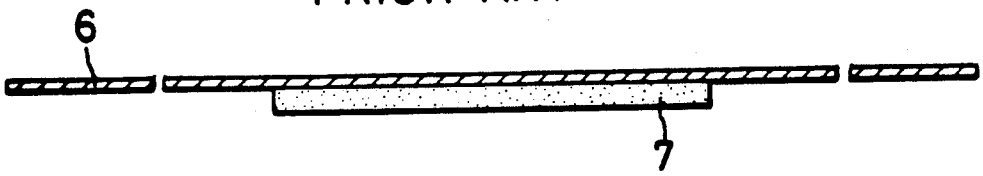
FIG. 7 PRIOR ART
Figure 8:
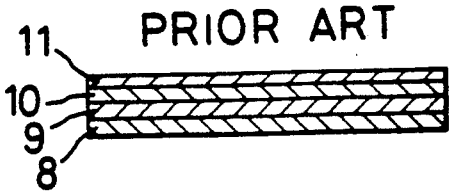
FIG. 8 PRIOR ART

The mask of this invention comprises an aluminum foil and a film of a resin provided thereon. The resin which can be employed for the mask is one which is not adhesive at an ordinary room temperature, but which can form a strong bond with a paint and a baked film thereof, as well as with the aluminum foil. It is essential for the resin not to melt at a baking temperature of, say, about 140° C., drop and stick to the surface of the article to be painted, and not to generate any vapor impairing the appearance or quality of the coated surface of the article. Specific examples of the resin which can be employed include polyvinyl chloride, polyester and polyamide resins.

The resin film preferably has a thickness of about 3 to 7 microns. The use of a film having too large a thickness results in the loss of the advantages which can be obtained when the aluminum foil is employed. A film having too small a thickness fails to hold a film of paint thereon.

The aluminum foil may be any aluminum foil that is usually employed in the art to which this invention pertains. The mask of this invention can be manufactured by employing any method that is usually employed for producing any conventional laminated material.

The invention will now be described more specifically with reference to a preferred embodiment thereof, though the following description is not intended for limiting the scope of this invention.

A mask embodying this invention is shown in FIG. 1. It comprises an aluminum foil 6 having a thickness of about 30 microns and a film 12 of a polyvinyl chloride resin provided on one surface of the foil 6 and having a thickness of about 3 to 7 microns.

The mask may be used in a way as shown by way of example in FIG. 2. The mask is unwound from a roll 13 and is cut to form a mask 14 having an appropriate length. The mask 14 is wound about the frame 16 of a rear door assembly 15 which has been given blackout coating. Tapes 17 and segments 18 and 19 of the material according to this invention are bonded to the opposite ends, respectively, of the mask 14 wound about the frame 16. The mask 14 is wound about the frame 16 as shown in FIG. 3. A paint is applied to give the final coating to the rear door assembly 15 and is baked in an oven. Then, the mask 14 is removed from the frame 16. The paint which has been sprayed over the mask forms a film 20 on the resin film 12, as shown in FIG. 4. The paint film 20 is firmly held on the resin film 12, or adheres strongly thereto, without peeling off and thereby causing any inconvenience at all.

What is claimed is:

1. A method of protecting a portion of a vehicle part during painting and subsequent baking, wherein said portion has a substantial irregular contour in cross-section, said method comprising:

providing a painting mask of aluminum foil having a selected length and width with an exposed surface, and a film of resin, having a length and width similar to the aluminum foil covering and adhering to an opposite surface of the foil, the film and foil forming a bonded deformable laminated sheet capable of retaining a deformed configuration when in conformance with an irregular contour;

orienting the laminated sheet with the exposed surface of aluminum foil adjacent to and opposing the surface of the protected portion of the part;

winding the laminated sheet about the protected portion helically while deforming the laminated sheet into intimate opposing relationship with the irregular contour of the protected portion of the part;

applying paint to both the vehicle part not protected by the laminated sheet and to the wound resin film of the deformed laminated sheet;

baking the painted masked and unmasked portions of the vehicle part at a selected temperature for a predetermined time period without the paint peeling from the resin; and removing from the protected baked vehicle part the wound laminated sheet without the paint peeling from the resin film.

2. The method of claim 1 wherein the step of providing the painting mask includes providing a roll of the laminated piece and cutting a selected length of the laminated piece from the roll.

3. The method of claim 1 wherein the step of providing the painting mask includes providing a resin film selected from the group consisting of polyvinyl chloride, polyester, and polyamide resins.

4. The method of claim 1 wherein the step of providing the painting mask includes providing a resin film having a thickness in the range of approximately three to seven microns.

5. The method of claim 1 wherein the step of providing the painting mask includes providing aluminum foil having a thickness of approximately 30 microns.

6. The method of claim 1 wherein the step of baking includes baking the masked and unmasked portion of the part at a temperature of at least 140° C. for the predetermined time period.

* * * * *